United States Patent [19]

Hein

[11] 3,997,104

[45] Dec. 14, 1976

[54] CENTRIFUGE ROTOR

[76] Inventor: George N. Hein, 331 Chesham Ave., San Carlos, Calif. 94070

[22] Filed: Apr. 9, 1975

[21] Appl. No.: 566,389

[52] U.S. Cl. ..... 233/26; 233/1 R

[51] Int. Cl.[2] ..... B04B 9/12

[58] Field of Search ..... 233/1 B, 1 R, 26, 27, 233/24, 23 R; 57/76, 77; 220/281; 215/363

[56] References Cited

UNITED STATES PATENTS

| | | | |
|---|---|---|---|
| 2,765,097 | 10/1956 | Dobson et al. | 220/281 |
| 2,827,229 | 3/1958 | Blum | 233/23 R |
| 3,456,875 | 7/1969 | Hein | 233/24 |
| 3,484,016 | 12/1969 | Turner | 220/281 |
| 3,845,872 | 11/1974 | Towns et al. | 220/281 |

*Primary Examiner*—George H. Krizmanich
*Attorney, Agent, or Firm*—R. J. Steinmeyer; F. L. Mehlhoff

[57] ABSTRACT

A rotor for a centrifuge including a symmetrically shaped rotor body adapted for rotation about its axis and including a suitable cavity for receipt of samples to be centrifuged. The rotor body is provided with means adapted to cooperate with a centrifuge driving means for rotating the rotor body abouts its axis for centrifuging liquid samples in the cavity. The rotor body is provided with an annular shoulder formed around the top of the rotor and surrounding the opening to the sample cavity, the shoulder having an inward facing surface adapted to receive a thin flexible disc having a bowed shape in the direction of the opening to the cavity so that the edge of the disc seats against the annular shoulder. In its preferred form the disc has a diameter greater than that of the annular space bounded by said shoulder and is bowed by a force against the center portion of the disc causing it to flex in the downward direction thereby assuming a "dish-shape" covering the opening to the cavity of the rotor body.

11 Claims, 5 Drawing Figures

CENTRIFUGE ROTOR

BACKGROUND OF THE INVENTION

The invention described herein relates generally to centrifuge rotors and more particularly to an improved lid or cover for closing the opening to the cavity of such a rotor.

It is desirable, in certain centrifugation practice, where large numbers of individual samples are constantly being centrifuged, to make the operation of the apparatus as simple as possible. In clinical work, for example, an operator must insert test tubes containing samples into the centrifuge rotor, attach the rotor cover, centrifuge the samples, then remove the cover and the individual test tubes and samples for clinical analysis. By increasing the centrifugation speeds, it becomes possible to greatly reduce the centrifugation time necessary to make certain separations. Air driven centrifuges, which employ a relatively small, light weight rotor can achieve extremely high rotational speeds and centrifugal forces which greatly reduce the time of separation. This means, of course, that the operator can load and unload the centrifuge rotor more often and at shorter time intervals. Anything that can be done to simplify this operation will, of course, increase the clinical efficiency and reduce the cost of analysis. One possible improvement is to make the lid or cover easily attached and detached from the opening to the rotor cavity into which the samples are inserted. Also, in an air driven centrifuge rotor, it is desirable to design the rotor so that its weight is kept at a minimum. Typical covers or lids for rotors have, in the past, been relatively heavy members which are retained in place by bolts or threaded retaining devices which must first be loosened or removed prior to removing the lid. It is desirable to make the cover as light as possible and to eliminate heavy coupling members which must be machined and mounted with nearly perfect concentricity for the sake of balance. This is especially true with rotor assemblies which rotate at ultra speeds such as in the case of an air-driven rotor which operates at well above 100,000 R.P.M.'s.

SUMMARY OF THE INVENTION

In accordance with the invention, there is provided a rotor for a centrifuge apparatus in the form of a rotor body symmetrically shaped about its axis of rotation and having at least one sample cavity formed therein, the cavity having an inlet opening at the top of the rotor body and including an annular shoulder formed around the top of the rotor and surrounding the inlet opening to the cavity, the shoulder having an inward facing surface adapted to receive a cover member in the form of a thin flexible disc being bowed in the direction of the opening to the cavity with the edge of the disc seated against the inward surface of the annular shoulder.

It is an object of this invention to provide a centrifuge rotor having an improved cover arrangement for closing the opening to a centrifuge cavity in the rotor and thereby sealing said cavity from external contamination or internal evaporation.

It is another object of the invention to provide an easily attached and detached cover for closing the opening to the centrifuge cavity in a rotor.

Further objects and advantages of the invention will become apparent as the following description proceeds, and the features of novelty which characterize the invention will be pointed out with particularity in the claims annexed to and forming a part of this specification.

DESCRIPTION OF THE PREFERRED EMBODIMENTS

Figure 1:
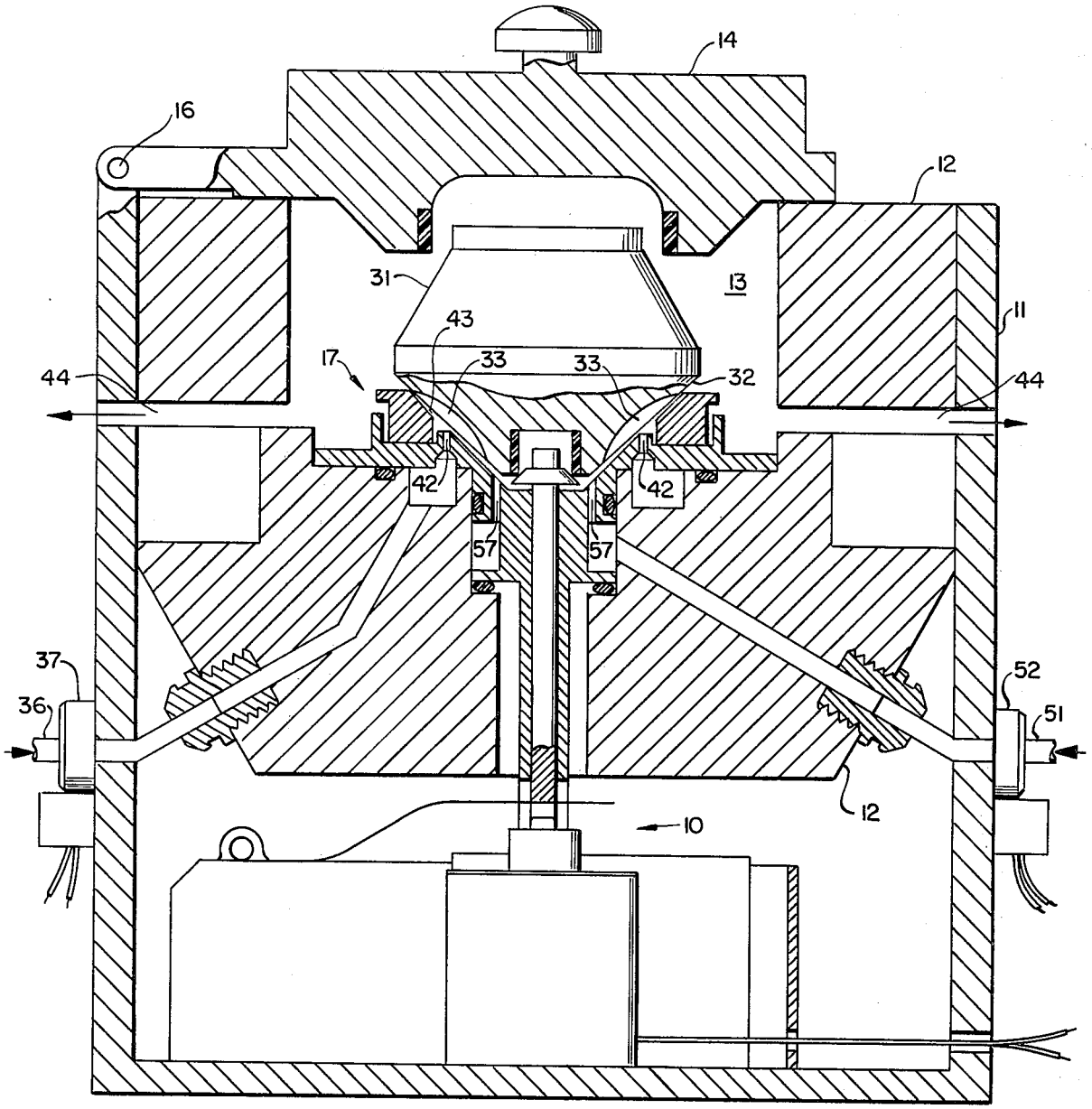
FIG. 1 is a cross-sectional elevation view of an air driven centrifuge having a rotor of the type to which the present invention is particularly applicable.

Referring now to FIG. 1 of the drawings, there is shown a centrifuge apparatus of the type referred to as an "air driven" centrifuge. The present invention is particularly well adapted for use with rotors employed in air driven centrifuges. This centrifuge apparatus includes an outer casing 11, which supports a housing 12, in which is formed a generally cylindrically shaped rotor chamber 13. Attached to the housing for closing the upper or open end of the rotor chamber 13 is a cover member 14 hinged at 16 to the case 11 so that it may be pivoted upwardly and out of the way of the open end of the rotor chamber 13. Disposed in the lower portion of the rotor chamber 13 on the bottom of the housing 12, is a rotor seat, generally designated by the reference numeral 17.

Mounted within the rotor chamber 13 on the rotor seat 17, is a rotor 31 having an underside 32 slanting upwardly in the outward direction. That is, the under sidewall 32 of the rotor 31 is conical shaped and is provided with a plurality of turbine flutes or vanes 33.

The conically shaped under-sidewall 32 of the rotor is designed to rest on the seat 17 when the rotor is not rotating. A pressurized driving air stream is conducted into the chamber 13 by means of a tube 36 and valve means 37 and delivered by air jet nozzles 42 positioned at spaced intervals within the seat 17. The introduction of driving air through the nozzles 42 impinges against the flutes 33 to rotate and support the rotor. The rotor is then supported at high speeds on a cushion of air between the rotor 31 and the seat 17 and does not touch the seat or any portion of the supporting housing. Air space 43, between the rotor and the seat 17, acts as an exit passage for compressed air after it has contacted, rotated and supported the rotor. The air then flows into the rotor chamber 13 and exits from the chamber through a plurality of openings 44.

In order to stop the rotor and support the rotor while it is decelerating, there is provided a second pressurized or levitation air stream introduced into the apparatus through tubing 51, valve means 52, and introduced into the area below the rotor 31 so that the support air stream does not cause rotation in either clockwise or counterclockwise directions. The levitation air stream supports the rotor when the driving air stream is inactivated so that the rotor may be conveniently stopped.

Also shown in FIG. 1 is a means for stopping this rotor in the form of a brake and stabilizer assembly, generally designated by the reference numeral 10. The brake and stabilizer means is described in the patent application, Ser. No. 567,255, filed in the name of Douglas Durland et al., concurrently filed with this patent application, and assigned to Beckman Instruments, Inc. The brake and stabilizer assembly forms no part of the present invention.

The rotor of the apparatus disclosed in FIG. 1, or as employed in an air driven centrifuge, is particularly well adapted for use with the cover member of the present invention. However, the cover member can be employed in the normal type centrifuge which is driven by a spindle, geared to an electrical motor or other driving force.

Figure 2:
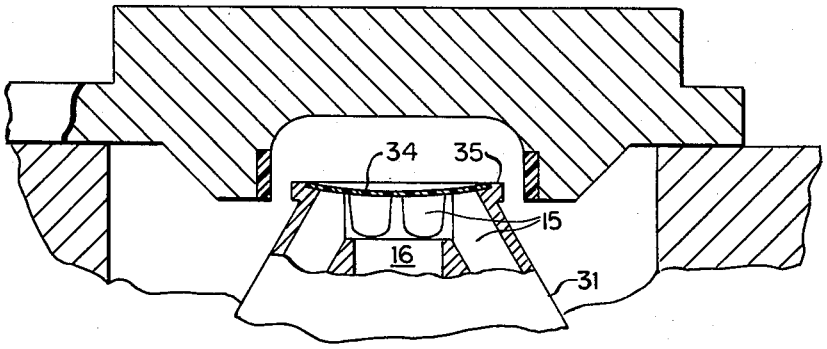
FIG. 2 is a fragmentary elevation view of a portion of the rotor of FIG. 1, illustrating the cover mounted across the opening to the rotor cavity.
Figure 3:
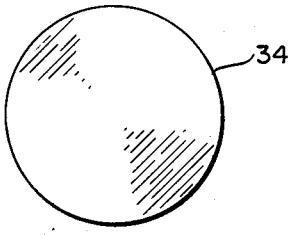
FIG. 3 is a plan view of the cover.
Figure 4:
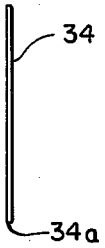
FIG. 4 is a side elevation view of the cover of FIG. 3 illustrating that the cover is flat in its unflexed position.

Referring now to FIG. 2, there is shown a cross section of the upper portion of the centrifuge of FIG. 1 illustrating the rotor 31 which, in this embodiment, is provided with a plurality of tube openings 15 leading into a central cavity 16 in the rotor. As illustrated in FIG. 2, the opening to cavity 16 in the rotor 31 is closed by a cover or lid member 34 which is inserted into a seat formed on the top of the rotor. The lid member comprises a circular disc, such as disc 34, illustrated in FIGS. 3 and 4. Circular disc 34 is formed of a thin flexible material, such as a plastic as polyethylene, vinyl, mylar, etc. Its normal unflexed shape is flat as indicated in FIG. 4. The disc could also be formed of a metal such as spring steel or any such thin suitable flexible material.

Figure 5:
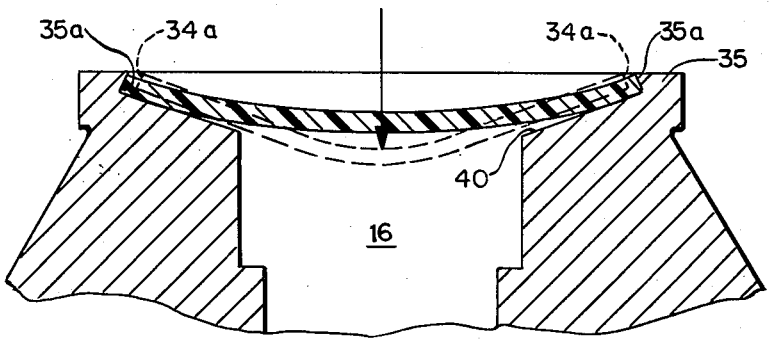
FIG. 5 is an enlarged cross-sectional view of the upper portion of the rotor and illustrating the manner in which the flexible cover is inserted and removed from the rotor.

As best seen in FIG. 5, in order to support and retain the cover 34, the rotor is provided with an upstanding annular shoulder 35, formed around the top of the rotor and surrounding the opening leading into the cavity 16 in the rotor. Shoulder 35 has a slanting or beveled surface 35*a*, which slants outwardly in the downward direction making the space encompassed by the annular shoulder 35 of a smaller diameter at its upper edge than it is at its lower edge. The annular surface 35*a* abuts a support portion 40 of the rotor 31 at an angle of approximately 90° to the slanting inner surface 35*a* of the shoulder.

The diameter of the cover or disc 34 is greater than the diameter of the opening or space encompassed by the shoulder 35, as will be noted in FIG. 5. However, the diameter of the disc 34 is not so great as to prevent it from being inserted into the seat provided by the annular shoulder. As shown in FIG. 5, the cover, in its preferred form, may be forced into a bowed or "dish-shape" by applying a force at the center thereof. When the disc is placed on the upper edge of the shoulder 35 and bowed, it slides over the upper edge of the shoulder 35 and slips down onto the surface 40, as shown in dotted lines in FIG. 5. When the force against the center of the disc is released, the edges 34*a* of the disc abut against the annular surface 35*a* which then holds the disc in the bowed or "dished" form. Inasmuch as the upper edge of the shoulder 35 is of lesser diameter than the lower edge of the shoulder, the disc 34 is retained by the shoulder across the opening to the cavity. When the rotor is spun at high R.P.M.'s, the cover 34 tends to flatten even further with the edge 34*a* of the cover being forced against the surface 34*a* of the shoulder 35 producing even greater pressure holding the cover in place and further increasing the pressure between the sealing surfaces.

In order to remove the cover, all that is necessary is to place a force with a finger in the center of the disc or cover 34, as illustrated in FIG. 5. This force causes the center portion of the cover to bend or buckle so that the edge 34*a* of the disc moves slightly away from the shoulder 35. A sharp instrument such as a pencil, fingernail or stylus may then be inserted against the edge 34*a* of the disc and the disc popped out of its seat against the shoulder 35. As can be seen from the above, the cover or disc member can easily be inserted and disengaged from the opening across the rotor, yet it is retained tightly in place against the shoulder 35 during rotation of the rotor at high speeds and thereby sealing the rotor cavity.

While in accordance with the patent statutes there has been described what at present is considered to be the preferred embodiment of the invention, it will be understood by those skilled in the art that various changes and modifications may be made therein without departing from the invention. For example, it is possible to provide the disc in a pre-stressed condition so that it takes on a permanent slightly bowed or dish-shape and the outer diameter of the dish is such as to just fit or tightly fit the annular space bounded by the annular shoulder 35. On rotation of the rotor at high speeds the slightly bowed disc will flex and the edge 34*a* move outwardly against the surface 35*a* to produce a tight seal. Using such a "slightly bowed" disc the surface 35*a* may be almost parallel to the axis of the rotor, although, in the preferred form, it is desirable that it have at least a slight outward slant in the downward direction. It is, therefore, the aim of the appended claims to cover all such changes and modifications as fall within the true spirit and scope of the invention.

What is claimed is:

1. A rotor for a centrifuge apparatus comprising:

a rotor body symmetrically shaped about its axis of rotation;

at least one cavity formed in said rotor body having an inlet opening through the top of said rotor body;

means associated with said rotor body for cooperating with centrifuge driving means for rotating said rotor body about its axis for centrifuging a liquid sample in said cavity;

an annular shoulder formed around the top of said rotor and surrounding the opening to said cavity, said shoulder having an inward facing surface; and a cover member in the form of a thin flexible disc having a diameter greater than that of said annular shoulder but small enough to permit the edge of said disc to seat against said annular shoulder when force is applied to the center portion of said disc, said disc movable between a first concave position and a second concave position inward toward said rotor cavity and within said annular shoulder, said edge of said disc in said first concave position being slightly spaced from said shoulder to allow insertion and removal of said disc with respect to said rotor, said edge of said disc in said second concave position being biased against said shoulder to secure said disc over said rotor cavity within said shoulder.

2. The rotor defined in claim 1 in which said inward facing surface slants outwardly in a downward direction toward said rotor cavity.

3. The rotor defined in claim 2 in which the inward facing surface of said shoulder and the thickness of said disc are substantially the same.

4. The rotor defined in claim 1 in which said means associated with said rotor body for cooperating with centrifuge driving means comprises a plurality of turbine flutes adapted to be driven by air jets in an air driven centrifuge.

5. The rotor defined in claim 2 in which said inward facing surface of said annular shoulder abuts against a surface on the top of said rotor which slants downwardly toward said cavity in a direction substantially 90° from said slanting surface of said shoulder.

6. The rotor defined in claim 1 in which said disc is formed of a plastic material.

7. The rotor defined in claim 1 in which said disc is formed of a polyethylene plastic.

8. In combination with a centrifuge rotor having a sample cavity with an inlet opening at the top of the rotor and an annular shoulder formed around the top of the rotor having an inward facing surface surrounding the inlet to said cavity, a cover for said cavity opening comprising:

a thin flexible disc, bowed to form a dish-shape, inserted in said inlet surrounded by said annular shoulder, said disc having a circumferential edge surface with a depth substantially equal to the thickness of said disc, said edge surface abutting said inward facing surface of said shoulder whereby centrifugal force during rotation of said rotor causes said disc to flex and the edge surface of said disc to seal tightly against said inward surface of said shoulder.

9. The combination defined in claim 8 in which said inward facing surface slants outwardly in a downward direction toward said rotor cavity.

10. The combination defined in claim 8 in which said disc is formed of a plastic material.

11. The combination defined in claim 8 in which said disc is bowed in the direction toward the inlet opening and the outer edge portions of said disc rest upon a portion of the top of said rotor which slants toward said cavity at an angle of substantially 90° to the inward facing surface of said shoulder.

* * * * *